US008251237B2

(12) United States Patent
Beaudonnet

(10) Patent No.: US 8,251,237 B2
(45) Date of Patent: Aug. 28, 2012

(54) READY-TO-MOUNT, MODULAR CONTAINER OR SAME-TYPE EQUIPMENT

(75) Inventor: Serge Beaudonnet, Lectoure (FR)

(73) Assignee: Etablissements Serge Beaudonnet, Lectoure (FR)

( * ) Notice: Subject to any disclaimer, the term of this patent is extended or adjusted under 35 U.S.C. 154(b) by 1039 days.

(21) Appl. No.: 11/572,709

(22) PCT Filed: Jul. 29, 2005

(86) PCT No.: PCT/FR2005/050634

§ 371 (c)(1),
(2), (4) Date: Jan. 26, 2007

(87) PCT Pub. No.: WO2006/021719

PCT Pub. Date: Mar. 2, 2006

(65) Prior Publication Data

US 2008/0000900 A1 Jan. 3, 2008

(30) Foreign Application Priority Data

Jul. 30, 2004 (FR) ..... 04 51746

(51) Int. Cl.
*B65D 6/00* (2006.01)

(52) U.S. Cl. ..... 220/4.28

(58) Field of Classification Search ..... 220/4.29, 220/622, 826, 4.28, 1.5, 6, 4.34, 7, 844, 4.31, 220/4.33; 206/512, 600; 229/122.25; 296/181.7, 296/29; 403/263, DIG. 10; 52/272; 493/137
See application file for complete search history.

(56) References Cited

U.S. PATENT DOCUMENTS

| | | | | |
|---|---|---|---|---|
| 3,182,846 | A * | 5/1965 | La Kaff | 220/4.28 |
| 3,221,921 | A | 12/1965 | Silverman | |
| 3,529,394 | A * | 9/1970 | Wilkins | 52/586.2 |
| 3,574,367 | A * | 4/1971 | Jankowski | 403/201 |
| 3,985,258 | A * | 10/1976 | Quigley et al. | 220/4.28 |
| 4,173,287 | A * | 11/1979 | Kumakawa | 217/65 |
| 4,577,772 | A | 3/1986 | Bigliard et al. | |
| 5,161,709 | A * | 11/1992 | Oestreich, Jr. | 220/6 |
| 6,854,234 | B2 * | 2/2005 | Gimpel et al. | 52/586.2 |

FOREIGN PATENT DOCUMENTS

DE 15 59 210 A 9/1969

(Continued)

OTHER PUBLICATIONS

International Search Report, Dec. 22, 2005, from International Phase of the instant application.

(Continued)

*Primary Examiner* — Anthony Stashick
*Assistant Examiner* — Jeffrey Allen
(74) *Attorney, Agent, or Firm* — Jackson Patent Law Office

(57) ABSTRACT

A structure includes a plurality of ready-to-mount panels forming a base and lateral walls. Each panel defines a plurality of edges each defining a length, each edge having a male profile or a female profile. The male form of a profile is configured to fit into the female form of another profile. Each profile holds a moveable member, each moveable member configured to move longitudinally along the edge. The structure further includes a plurality of longitudinal members each passing through the moveable member of a male profile of a first panel and the moveable member of a female profile of a second panel, to hold the first and second panels in fitted position.

19 Claims, 7 Drawing Sheets

FOREIGN PATENT DOCUMENTS

| | | | |
|---|---|---|---|
| DE | 21 23 882 | A | 11/1972 |
| DE | 34 24 498 | A1 | 1/1986 |
| EP | 1 182 149 | | 2/2002 |
| FR | 2 347 266 | A | 11/1977 |
| WO | WO 89/03733 | A | 5/1989 |
| WO | WO 03/018438 | A1 | 6/2006 |

OTHER PUBLICATIONS

English Translation of International Preliminary Report on Patentability Chapter II, Jun. 5, 2007, from International Phase of the instant application.

* cited by examiner

READY-TO-MOUNT, MODULAR CONTAINER OR SAME-TYPE EQUIPMENT

FIELD OF THE INVENTION

This invention relates to the field of enclosures, containers, bins or similar equipment of the same type and in particular to adaptations making it possible to produce them and use them under the best conditions.

DESCRIPTION OF THE PRIOR ART

The applicant has noted that the containers and bins of the prior art have the disadvantages of occupying a large volume, which contributes to their cost when their transportation or storage is necessary, and of having a configuration, a profile that, designed for one function or use, does not enable them to be used effectively for other purposes.

To overcome these disadvantages, there are containers in this field, as described by the international document WO 03/018438, which proposes a foldable transport container with a substantially parallelepiped-shaped external structure, including a base, a cover that is substantially parallel to the base, two substantially parallel sides and two substantially parallel front sides, in which the container can be placed in the empty transport position in which its transportation volume is reduced. The container includes four support elements that are respectively positioned at the level of the parallelepiped corners and that connect the base to the cover. When said container is in transport mode, the support elements to which the front sides are attached are perpendicular to the base, and when the container is in the empty transport mode, the support elements are parallel to the base.

This technological solution, while proposing a solution to the problem of volume, has the disadvantage of being applicable only to containers, of requiring the presence of four support elements and of having no modularity, for example, for adapting its volume to its transport function.

Also in the field of containers, the prior art includes the container described and represented in the European document EP 1 182 149, which proposes a modular demountable container of which the bottom frame comprises, on its corners, four legs that extend according to a T-profile so as to enable the assembly of pillars that engage with said legs, the front and rear sides of the container being connected to said pillars, the lid and the lateral walls then being attached to one another. This technological solution, while proposing a solution to the problem of volume, has the disadvantage of being applicable only to containers, of requiring the presence of the four support elements or pillars and of having no modularity, for example, for adjusting its volume to its transport function. Indeed, the modularity proposed in this document concerns only the multiplication of the number of containers capable of being used together.

In general, the devices of the prior art, when they become demountable, propose corner pillars or corner attachments, which does not allow for modularity or the extension of the capacities of the container beyond the volume defined by the corner attachments.

DESCRIPTION OF THE INVENTION

In consideration of this, the applicant has conducted research to overcome the aforementioned disadvantages by proposing a container, a bin or any other equipment of this type, such as a shed, etc., capable of taking up less space during transport or storage and having an adjustable structure and volume depending on the function that may be adopted by the container.

This research has led to the design of a container, bin or other equipment of the same type such as a shed, that is remarkable in that it is constituted by a plurality of ready-to-mount panels forming at least the base and certain lateral walls, the edges of each panel being equipped with profiles that fit together so as to be capable of cooperating with the panel edges equipped with profiles with which it comes into contact, thus facilitating the positioning and holding of the position with which it is associated by mounting or assembling mechanically welded panels that, by modularity, make it possible to assemble any type of material.

Said profiles are held in the fitted position of one panel with respect to another by means of screws at least partially passing through said profiles and cooperating with flanges.

The assembly is therefore advantageously achieved by means of profiles associated with means for holding position by screwing, which make it possible to avoid any welding operation. The mounting of panels is achieved by special movable flanges embedded in the profiles.

Thus, the profiles of the invention are elements added to the panels and can, depending on their orientation, serve as an attachment to panels in the same plane as those with which they are associated in order to enlarge the volume of the container. These profiles are not therefore stationary corner attachment parts or corner parts associated, for example, perpendicularly with a wall and to which the panels are attached.

The panels of the invention are therefore not preformed to adopt a profile but are equipped with added profiles.

The invention has numerous advantages, including:

- The containers and the bins can be transported entirely demounted in ready-to-mount elements regardless of the final volume. For example, a semi-trailer platform conventionally transports two bins of 30 cubic metres, while it is capable of transporting some dozen ready-to-mount bins of the same volume;
- The use of profiles, the absence of a welding connection and the preliminary finishing operations on each panel (painting, etc.) makes it possible to envisage an assembly time of one hour;
- The use of non-permanent attachment profiles serving as a standardized interface between the different pre-fabricated elements provides the possibility of modulating, transforming and adapting the container or the bin by means of optional elements such as sliding or hydraulic caps, shutter-type flaps, sealed doors, and so on;
- The use of separable elements facilitates the repair of the bin or container by simple replacement of the damaged element.

The invention thus provides, by a simple assembly/disassembly of panels, great possibilities for transforming volumes and forms in length, width or height without special adaptation parts and without corner parts.

The fundamental concepts of the invention mentioned above in their most basic form, other details and characteristics will become clearer on reading the following description and with regard to the appended drawings, providing, by way of a non-limiting example, a plurality of embodiments of a container/bin according to the invention.

DESCRIPTION OF PREFERRED EMBODIMENTS

Figure 1:
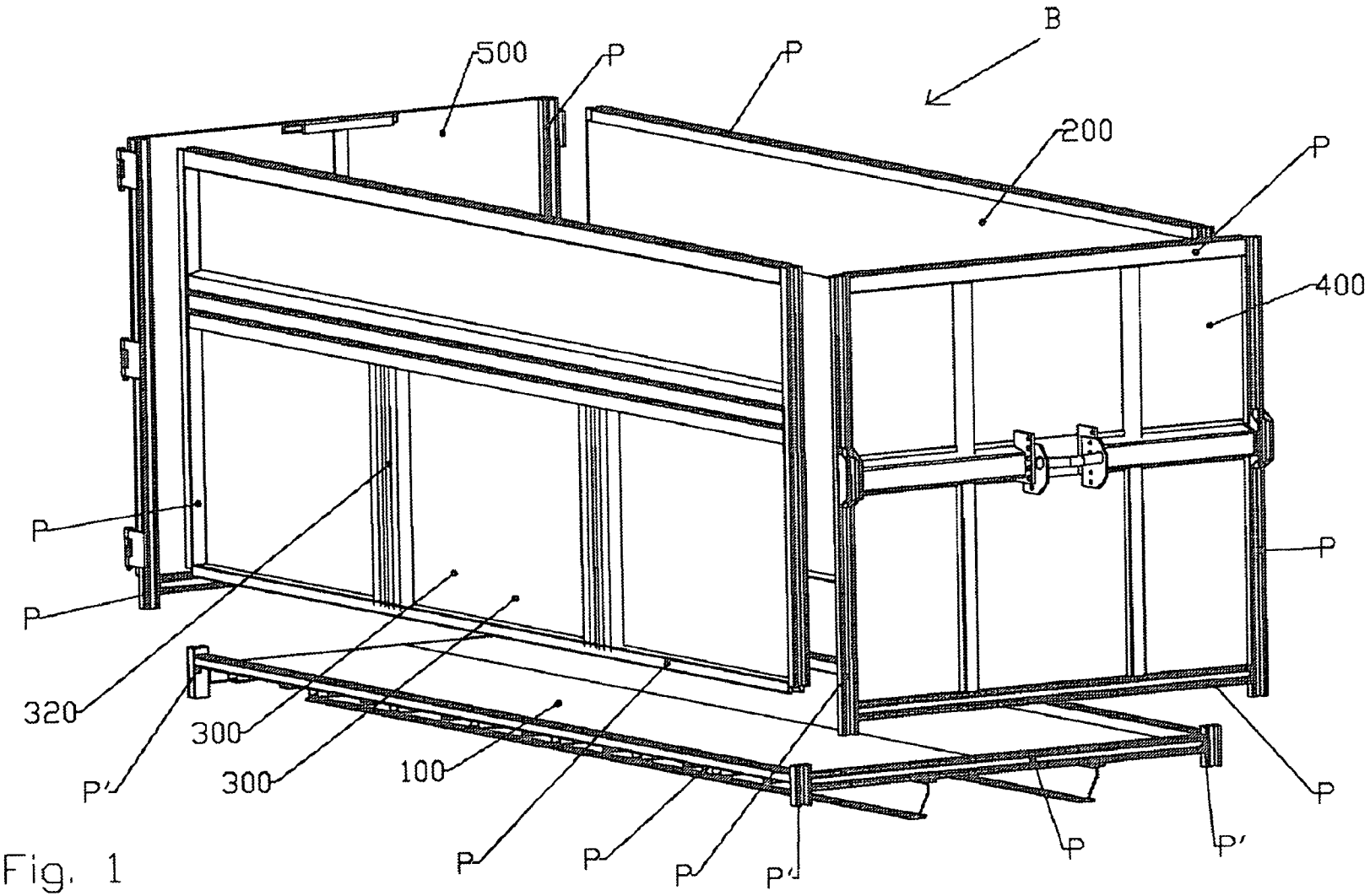
FIG. 1 is a drawing of a perspective view of an embodiment of ready-to-assemble constituent parts of a ready-to-mount bin according to the invention.

As shown in the drawing of FIG. 1, the container adopting the configuration of a bin that, in its entirety referenced B, is constituted by the assembly of a plurality of panels, namely:

- a panel forming a platform 100,
- two vertical longitudinal panels forming sides 200 and 300,
- a front vertical transverse panel forming the front wall 400,
- a rear vertical transverse panel forming the rear wall, in this case a door 500.

Depending on the embodiment shown, each panel, for example panel 300, is mechanically welded and comprises planar surfaces 310 associated with ribs or reinforcing elements 320.

According to the invention, each panel is equipped on its sides or edges, with assembly means allowing for its attachment to the other panels forming the bin B. These assembly means are advantageously constituted by profiles P of which the recessed and projecting forms are capable of corresponding so as to be fit together and enable the positioning and attachment of panels to one another. According to the non-limiting embodiment shown, the profiles P are added elements themselves welded to the panel edges. According to their orientation, they provide possibilities of attachment in the extension of the plane formed by the panel with which they are associated, or perpendicularly to said plane.

Thus, as shown, one of the longitudinal profiles P of the platform 100 cooperates with the bottom longitudinal profile P of side 300 so as to position and attach the vertical panel 300 on the platform 100. The same is true of the other vertical panel 200.

According to the preferred embodiment shown, the panel forming the base wall, i.e. the platform 100, comprises, on its four sides, horizontal profiles P vertical profile portions P' at its four corners. These profile portions P' extend the bottom end of the vertical profiles P of the vertical longitudinal panels 200 and 300 when the latter are placed on the platform 100.

The profiles P of the vertical transverse panels 400 and 500 are then positioned and attached to the horizontal profiles P provided on the platform 100 as well as to the profile resulting from the association of the vertical profiles P of the vertical longitudinal panels 200 and 300 with the profile portions P' of the corners of the platform 100.

Figure 2:
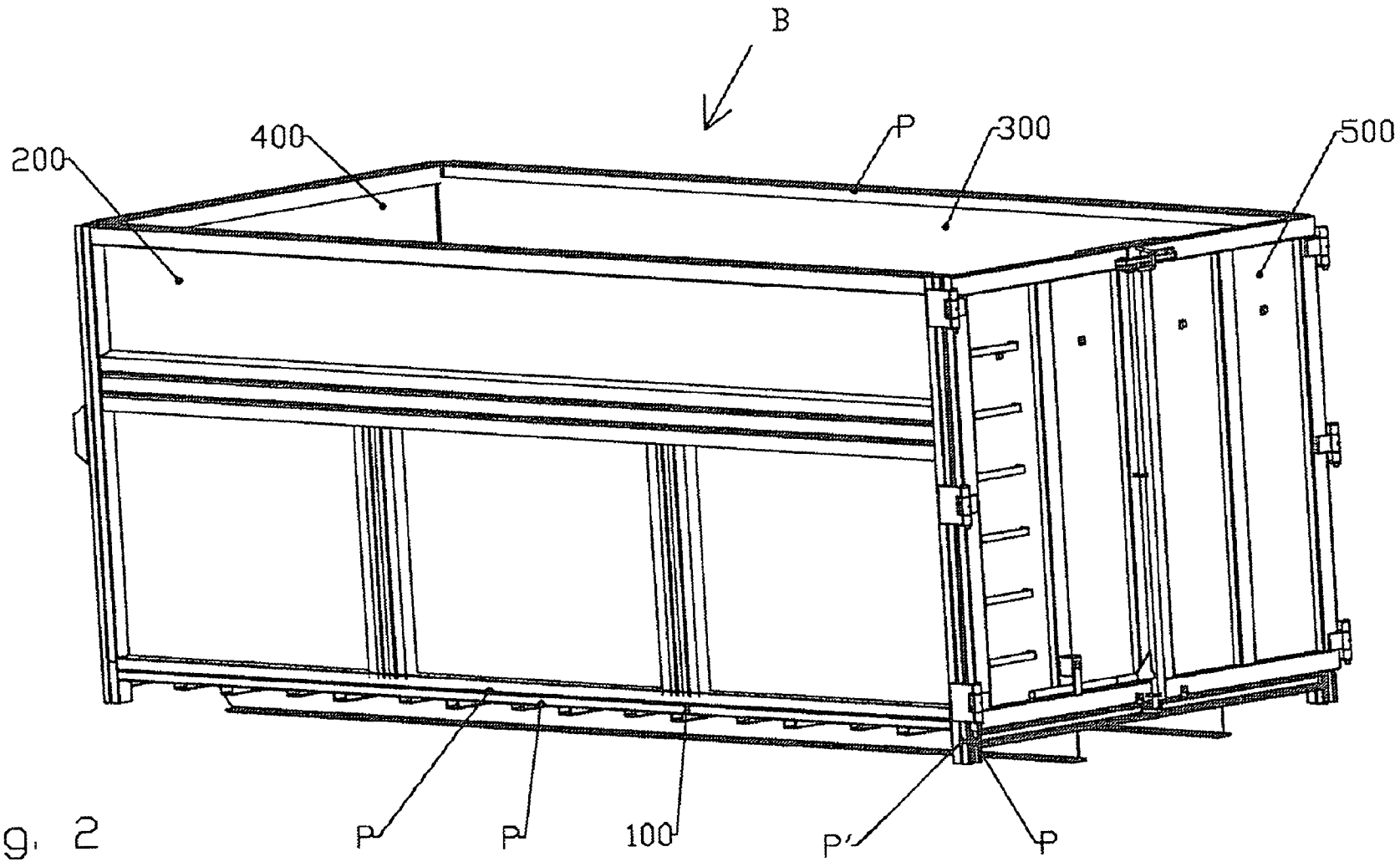
FIG. 2 is a perspective drawing of the bin of FIG. 1 once mounted.

The result of the assembly is shown in FIG. 2.

As shown, the bin B does not have a top. Nevertheless, according to the invention, a top or any other equipment can be attached owing to the profiles P present on the upper edges of the vertical panels 200, 300, 400 constituting the bin B.

To satisfy the objectives of modularity of the invention, the profiles allow for the attachment of vertical panels of different height and equipped on their sides with the necessary profile. Thus, the panels 300 and 400 can be replaced according to the application by panels of smaller or larger size. Similarly, the panel 500 composed of a double-flap door can be replaced by a full and stationary panel of a different height, or not be replaced.

The profiles P that ensure the positioning and holding of the position of the panels while allowing for the modularity of the contents have been the subject of specific research by the applicant. Indeed, according to a particularly advantageous feature of the invention, the attachment of panels to one another is performed by screwing. This feature complies with the ready-to-mount principle applied by the container of the invention, makes it possible to envisage complete modularity, and prevents the need for specific expertise in order to perform the mounting or demounting.

Figure 3:
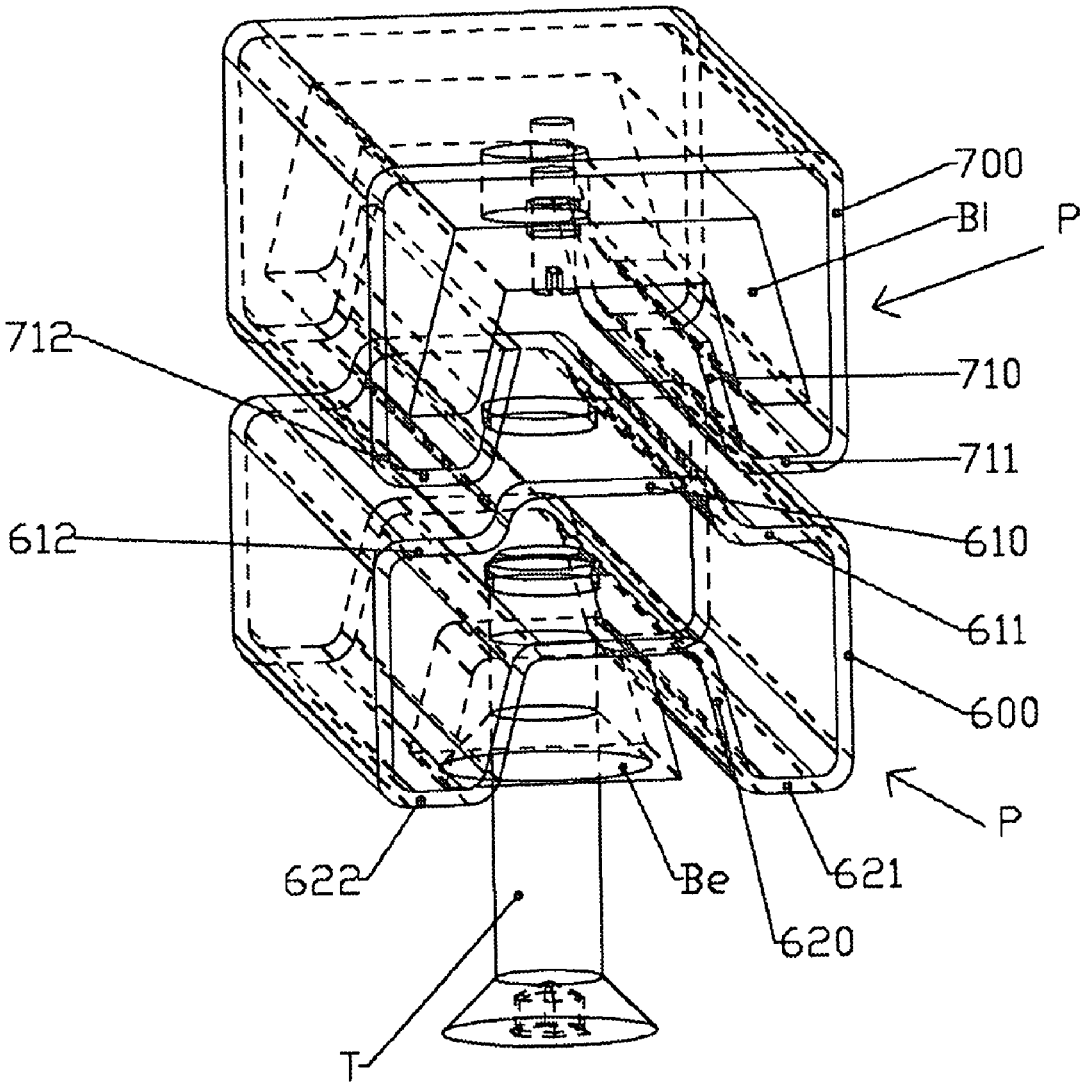
FIG. 3 is a perspective detail view of an embodiment of two assembled profiles.
Figure 4:
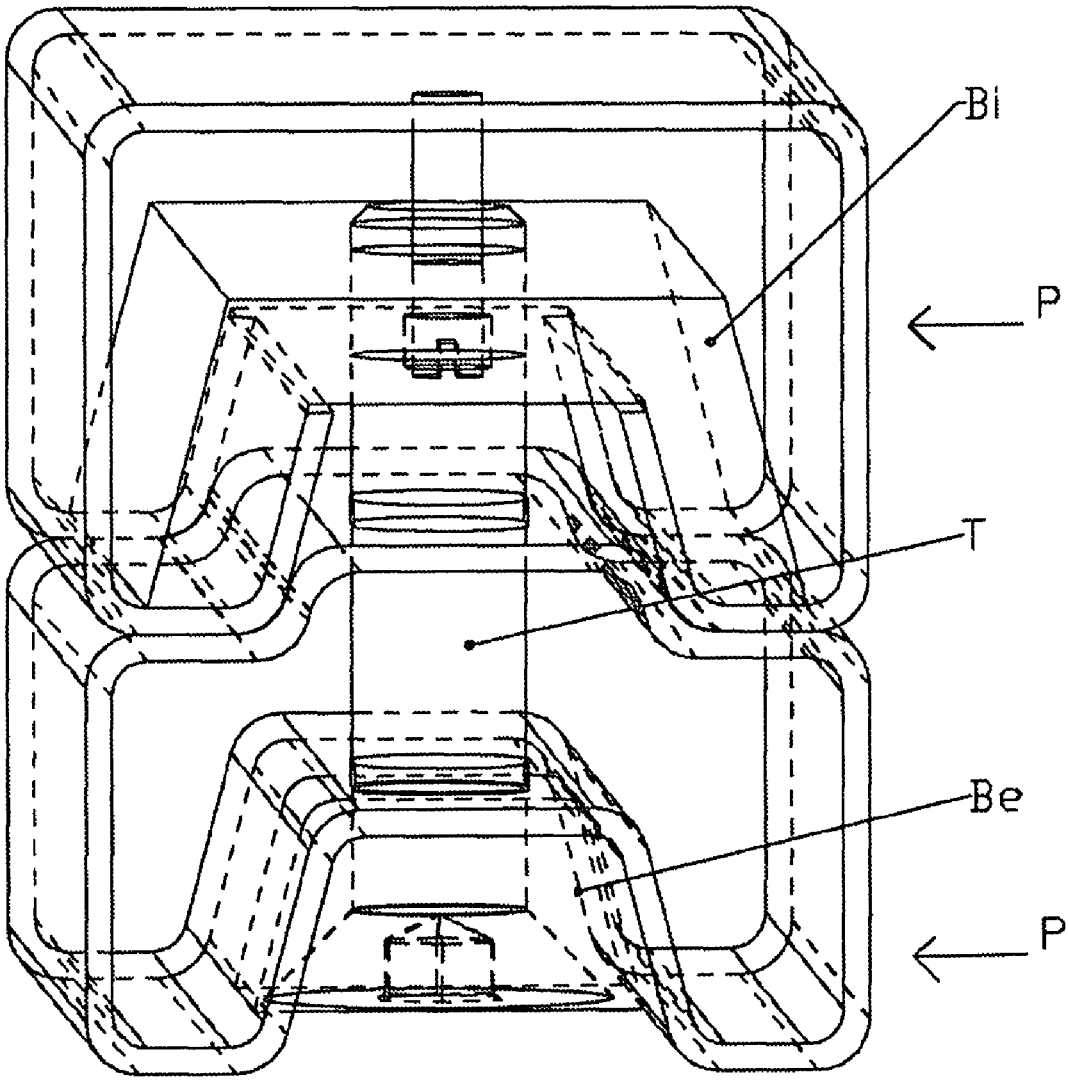
FIG. 4 is a perspective detail view of the profiles of FIG. 3 assembled.

To implement it, in accordance with the invention, and according to the embodiment shown in FIGS. 3 and 4, the profile adopts a convex male form and/or a concave female form, the male form of a first profile being capable of fitting into the female form of a second profile.

More specifically, the profile P can adopt two profile forms 600 and 700 according to its situation and according to the panel supporting it.

The first profile 600 adopts a convex male form 610 and a concave female form 620 arranged on opposite sides of the profiles. The male form 610 of a first profile adopting this first profile is capable of fitting into the female form 620 of a second profile also adopting this first profile. The profile is preformed so that each male form 610 or female form 620 is associated with bearing surfaces 611, 612 and 621, 622 on which the bearing surfaces of the profiles P coming into contact with this profile are supported.

The second profile 700 is semi-open and adopts a female recessed form 710 in which the male form 610 of the first profile 300 can fit. As shown, the recessed volume 710 is associated with bearing surfaces 711 and 712.

An example of a screw attachment is shown in FIGS. 3 and 4.

According to the invention, said profile is hollow and receives, in its internal volume, at least one so-called internal flange capable of moving inside the profile. The same is true of the two profiles 600 and 700 adopted by profiles P, which are hollow and capable of receiving, in their internal volume, at least one so-called internal flange referenced Bi capable of moving longitudinally inside said profiles.

In addition, the female form 620 of the profiles, i.e. in this case profile 600, receives at least one so-called external flange referenced Be, which is capable of moving in said female form 620.

According to the embodiment shown, said internal flange Bi comprises means for holding the position inside profile P, in this case constituted by a headless set screw of which the split end is accessible through the opening formed by the female form 710 provided in the profile 700.

The flanges Bi and Be are pierced with a hole, of which that of the internal flange Bi is tapped, the attachment of the two profiles, which are pierced to this end, being performed by screwing between the two profiles P, in this case 600 and 700, by placing them at the same level of the internal flange Bi moving inside a first profile with the external flange Be moving on a second profile P, a threaded rod T connecting them and consequently connecting the two profiles P together.

This type of attachment has a number of advantages, including:

- This is a screw attachment consequently allowing for demounting and the ready-to-mount principle;

The screws are associated with fitted forms as well as with bearing surfaces that receive the majority of the stresses and forces exerted on the panels to which they are connected;

The flanges are capable of being moved over the length of the profiles, allowing great freedom in their positioning so as to enable them to be adapted to any height or length of profile to be received;

The apertures and the volumes allowing the screws to pass through one profile to another are located on the centre of the profiles and are therefore closed when the bearing surfaces of a profile cooperate with those of the profile to which it is connected, and so on.

An alternative to the simple demounting, for solving the problem of bulk of containers to be stored or to be moved is shown in FIGS. 5, 6, 7*a*, 7*b*, 7*c* and 7*d*.

Figure 5:
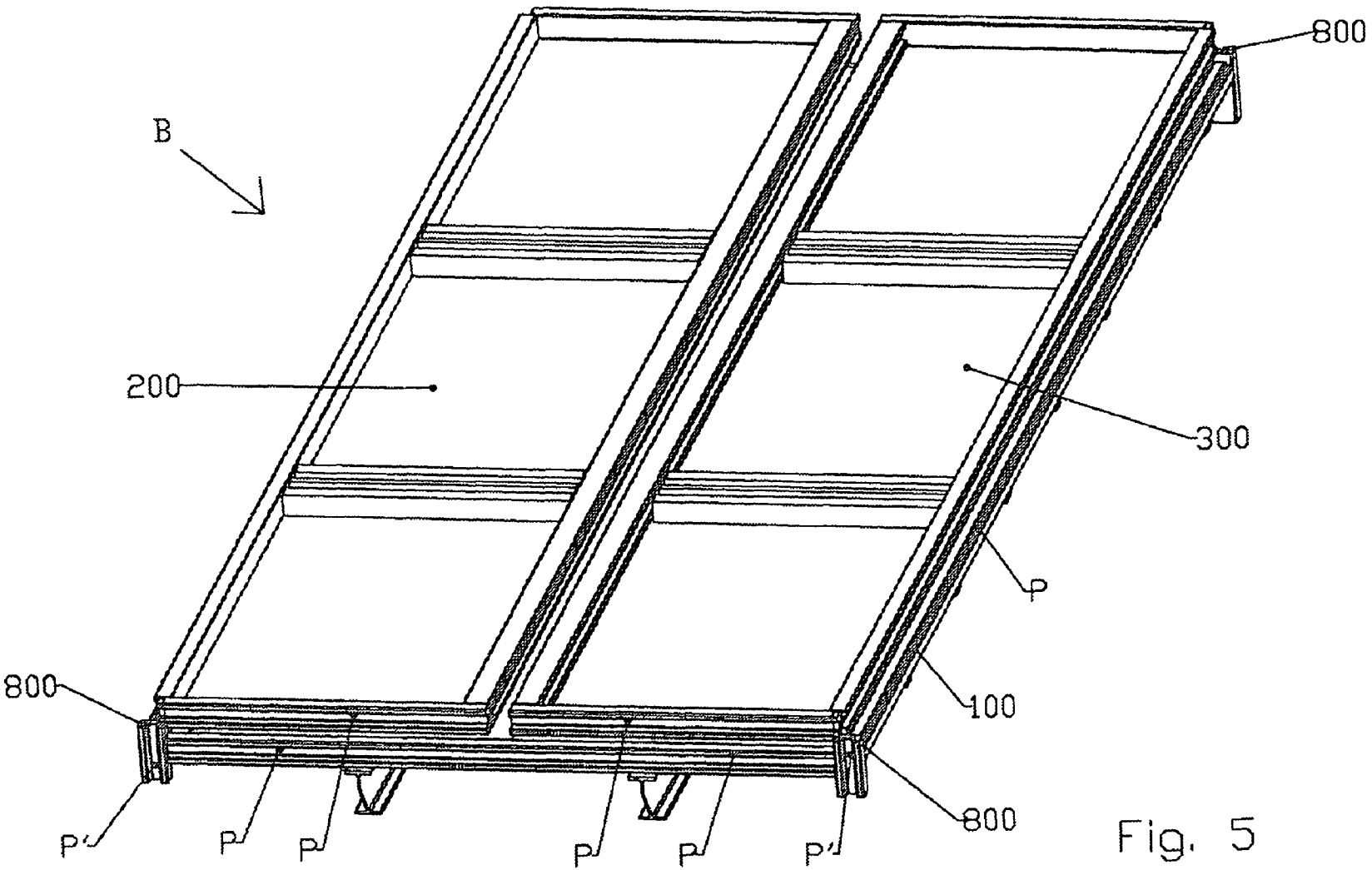
FIG. 5 is a drawing of a perspective view of an embodiment of the container equipped with pivoting means for the lateral panels.
Figure 6:
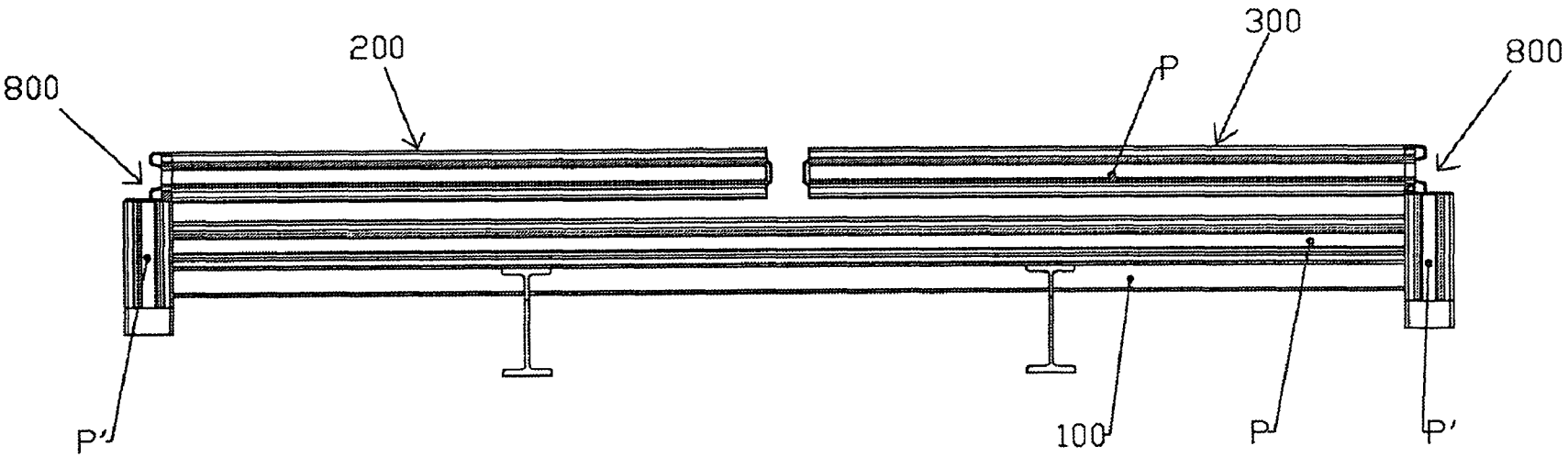
FIG. 6 is a front view showing the container of FIG. 5 in the folded position.
Figure 7B:
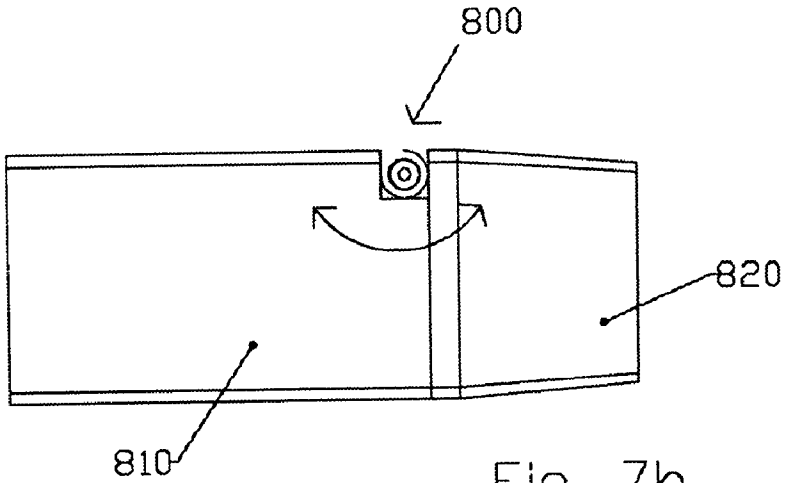
FIGS. 7*a*, 7*b*, 7*c* and 7*d* are drawings of perspective, bottom, front and right-side views, respectively.
Figure 7C:
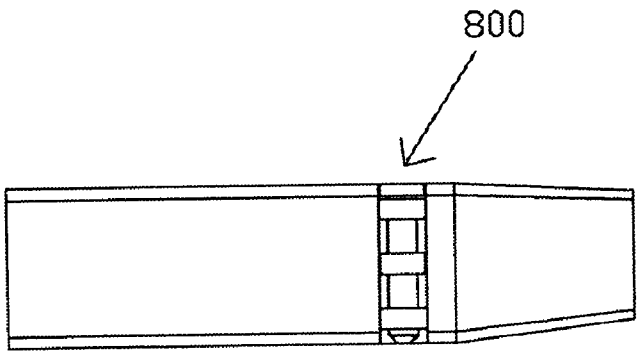
Figure 7A:
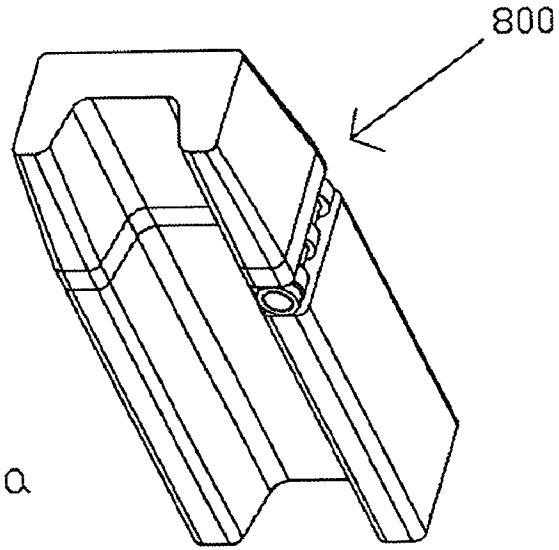
Figure 7D:
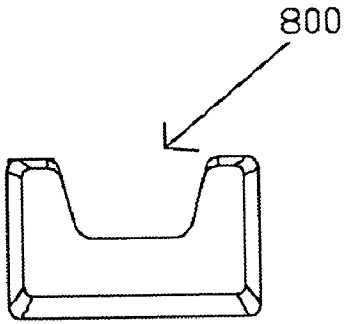

According to the embodiment shown, and in accordance with the invention, the panel 100 forming the base wall constituting the container or the bin B includes pivoting elements 800 on the vertical panels with which it cooperates so as to cause them to move from a vertical position to a horizontal position on the platform 100 shown in FIGS. 5 and 6.

As shown in the drawing of FIGS. 7*a*, 7*b*, 7*c* and 7*d*, said pivoting elements 800 are constituted by a hinge of which the two parts 810 and 820 adopt the same profile but of smaller size than that of profiles P or P' provided on the panels, so as to introduce and attach it.

It is understood that the container, which has just been described and shown above, was done so for the purpose of disclosure rather than limitation. Obviously, various arrangements, modifications and improvements can be used in the example above, without going beyond the scope of the invention as defined in the claims.

Thus, for example, the profile or the form of the profiles can change when it enables the profiles, and consequently the panels, to fit together.

Moreover, the mechanically welded panels described in the embodiment can be associated with, or replaced by, isothermal panels, insulating panels, double-walled panels, and so on.

Of course, the sizes and combinations described above are non-limiting, as the modularity of the various panels allows for the variation of all of the lengths of the container.

The invention claimed is:

1. A structure defining a volume, the structure characterised in that it is constituted by:

a plurality of ready-to-mount panels forming a base and lateral walls, each panel defining a plurality of edges, each edge defining a length and having a male profile or a female profile, the male profile extending longitudinally along most of the length and defining a convex male form, the female profile extending longitudinally along most of the length and defining a concave female form, the male form of a profile configured to fit into the female form of another profile, each profile corresponding to a respective moveable member, each respective moveable member configured to move longitudinally along the profile; and a plurality of longitudinal members, each longitudinal member being threaded, each longitudinal member passing through the respective moveable member of a male profile of a first panel and through the respective moveable member of a female profile of a second panel, while the male form of the male profile of the first panel is fitted into the female form of the female profile of the second panel, to hold the first and second panels in fitted position.

2. A structure according to claim 1, characterised in that each longitudinal member includes a screw, and each moveable member includes a flange .

3. A structure according to claim 1, characterised in that the female profile is hollow and receives, in its internal volume, the corresponding moveable member.

4. A structure according to claim 1, characterised in that a form is associated with bearing surfaces on which bearing surfaces of another form are supported.

5. A structure according to claim 1, characterised in that the moveable member of the female profile of the second panel is tapped.

6. A structure according to claim 1, characterised in that the panel forming the base wall constituting the structure includes pivoting elements of vertical panels with which it cooperates so as to cause them to move from a vertical position to a horizontal position on the base wall.

7. A structure according to claim 6, characterised in that the pivoting elements are constituted by a hinge including two parts that adopt the same profile, but of smaller size than that of the profiles provided on the panels so as to introduce and attach it.

8. A structure according to claim 1, characterised in that the panel forming the base wall comprises, on its four sides, horizontal profiles and vertical profile portions at its four corners.

9. A structure according to claim 1 wherein each panel defines 4 edges.

10. A set of components configured to assemble a structure defining a volume, the set of components comprising:

a plurality of ready-to-mount panels configured to form a base and lateral walls, each panel defining a plurality of edges, each edge defining a length and having a male profile or a female profile, the male profile extending longitudinally along most of the length and defining a convex male form, the female profile extending longitudinally along most of the length and defining a concave female form, the male form of a profile configured to fit into the female form of another profile, each profile configured to correspond to a respective moveable member, each respective moveable member configured to move longitudinally along the profile; and a plurality of longitudinal members, each longitudinal member being threaded, each longitudinal member configured to pass through the respective moveable member of a male profile of a first panel and through the respective moveable member of a female profile of a second panel, while the male form of the male profile of the first panel is fitted into the female form of the female profile of the second panel, to hold the first and second panels in fitted position.

11. A set of components according to claim 10 wherein each longitudinal member includes a screw, and each moveable member includes a flange.

12. A set of components according to claim 1 wherein the female profile is hollow and receives, in its internal volume, the corresponding moveable member.

13. A set of components according to claim 10 wherein a form is associated with bearing surfaces on which bearing surfaces of another form are supported.

14. A set of components according to claim 10 wherein the panel forming the base wall includes pivoting elements of vertical panels with which it cooperates so as to cause them to move from a vertical position to a horizontal position on the base wall.

15. A set of components according to claim 14 wherein the pivoting elements are constituted by a hinge including two parts that adopt the same profile, but of smaller size than that of the profiles provided on the panels so as to introduce and attach it.

16. A set of components according to claim 10 wherein the panel forming the base wall comprises, on its four sides, horizontal profiles and vertical profile portions at its four corners.

17. A set of components according to claim 10 wherein each panel defines 4 edges.

18. A structure according to claim 1 wherein the male profile of the first panel and the female profile of the second panel separate the respective moveable member of the male profile of the first panel from the respective moveable member of the female profile of the second panel.

19. A set of components according to claim 10 wherein the male profile of the first panel and the female profile of the second panel separate the respective moveable member of the male profile of the first panel from the respective moveable member of the female profile of the second panel.

* * * * *